US006699049B1

(12) United States Patent
Wu

(10) Patent No.: US 6,699,049 B1
(45) Date of Patent: Mar. 2, 2004

(54) ELECTRICAL CONNECTOR WITH ENHANCED HOUSING STRUCTURE

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/400,230

(22) Filed: Mar. 26, 2003

(51) Int. Cl.[7] ..... H01R 12/00

(52) U.S. Cl. ..... 439/79; 439/660; 439/680; 439/924.1

(58) Field of Search ..... 439/79, 660, 677, 439/680, 567, 924.1

(56) References Cited

U.S. PATENT DOCUMENTS 5,656,184 A * 8/1997 Jones et al. ..... 219/121.64
5,876,222 A * 3/1999 Gardner et al. ..... 439/79
5,993,263 A * 11/1999 Sampson ..... 439/660
6,036,549 A * 3/2000 Wulff ..... 439/660
6,203,353 B1 * 3/2001 Huang et al. ..... 439/352
6,217,347 B1 * 4/2001 Schell et al. ..... 439/79
6,319,022 B1 * 11/2001 Hwang ..... 439/79
6,331,122 B1 * 12/2001 Wu ..... 439/567
6,343,951 B1 * 2/2002 Ono et al. ..... 439/571
6,402,552 B1 * 6/2002 Wagner ..... 439/606
6,447,340 B1 * 9/2002 Wu ..... 439/660
6,494,749 B1 * 12/2002 Chang ..... 439/701
6,565,383 B1 * 5/2003 Wu ..... 439/567
6,575,783 B1 * 6/2003 Wu ..... 439/540.1
6,585,536 B1 * 7/2003 Wu ..... 439/358
6,585,537 B1 * 7/2003 Lee ..... 439/358
6,589,074 B1 * 7/2003 Wu ..... 439/540.1
6,589,077 B1 * 7/2003 Wu ..... 439/567
6,592,401 B1 * 7/2003 Gardner et al. ..... 439/544
6,623,299 B1 * 9/2003 Liu ..... 439/604

* cited by examiner

*Primary Examiner*—Ross Gushi
(74) *Attorney, Agent, or Firm*—Wei Te Chung

(57) ABSTRACT

An electrical connector (1) includes an insulating housing (10), a number of terminals (20) received in the housing, and a pair of board locks (30) retained in the housing for securing the housing on a printed circuit board. The housing includes a body (11) having a middle section (110) and a mating tongue (12) extending from the middle section. The mating tongue defines a number of channels (120) receiving corresponding terminals. The body has a pair of arms (112) extending parallelly beside the mating tongue. Each arm includes a horizontally extending wall (1123) extending above the mating tongue. A space (13) is defined between the walls and the mating tongue for receiving a mating complementary connector.

16 Claims, 8 Drawing Sheets

ELECTRICAL CONNECTOR WITH ENHANCED HOUSING STRUCTURE

BACKGROUND OF THE INVENTION

1. FIELD OF THE INVENTION

The present invention generally relates to an electrical connector, and particularly to an electrical connector mounted on a printed circuit board.

2. DESCRIPTION OF PRIOR ARTS

Serial Advanced Technology Attachment (Serial ATA) connectors provide a storage interface for ATAPI (Advanced Technology Attachment Packet Interface) devices and hard disk drives, which are main storage peripheral devices of computer systems. Conventionally, a Serial ATA connector comprises an insulating housing and a plurality of terminals received in the housing. Such Serial ATA plug and receptacle connectors can be found in U.S. Pat. No. 6,402,552 and Taiwan Patent Issue Nos. 493301, 493804, and 509393. Generally, the insulative housing of the Serial ATA connector includes a main portion, a mating portion extending from the main portion and receiving the terminals, and one side arm extending from one lateral side of the main portion. The side arm defines an inner groove for guiding insertion of a complementary mating connector. A space is defined between a lateral edge of the mating portion and the adjacent side arm. However, such conventional Serial ATA connectors as shown in U.S. Pat. No. 6,447,340, usually suffer from a breakage over a period of use, under repeated insertion, and withdrawal of a mated cable connector, which will adversely influence the signal transmission. Specifically, the housing will be easily broken along a vertical line on the side arm where the side arm connects to the main portion when the complementary connector is pulled in a right-and-left direction repeatedly. Similarly, the housing will be also easily broken along a horizontal line on the side arm where the side arm connects to the main portion and on the mating portion where the mating portion connects to the main portion when the complementary mating connector is pulled up and down repeatedly.

Hence, it is desirable to enhance the structural stability of Serial ATA connectors to ensure the signal transmission reliability.

BRIEF SUMMARY OF THE INVENTION

Accordingly, it is a major object of the present invention to provide a Serial ATA connector having an enhanced housing structure for improving the rigidity of the connector and improving overall connector integrity.

In order to achieve the above-mentioned object, a Serial ATA connector in accordance with the present invention for engaging a complementary connector, includes an insulating housing, a plurality of terminals received in the housing, and a pair of board locks retained in the housing for securing the housing on a printed circuit board. The housing comprises an H-shaped body having a middle section and a mating tongue extending from the middle section. The mating tongue defines a plurality of channels receiving corresponding terminals. The body has a pair of arms extending parallelly beside the mating tongue, each arm including a wall extending above the mating tongue. A space is defined between the walls and the mating tongue for receiving the mating complementary connector.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
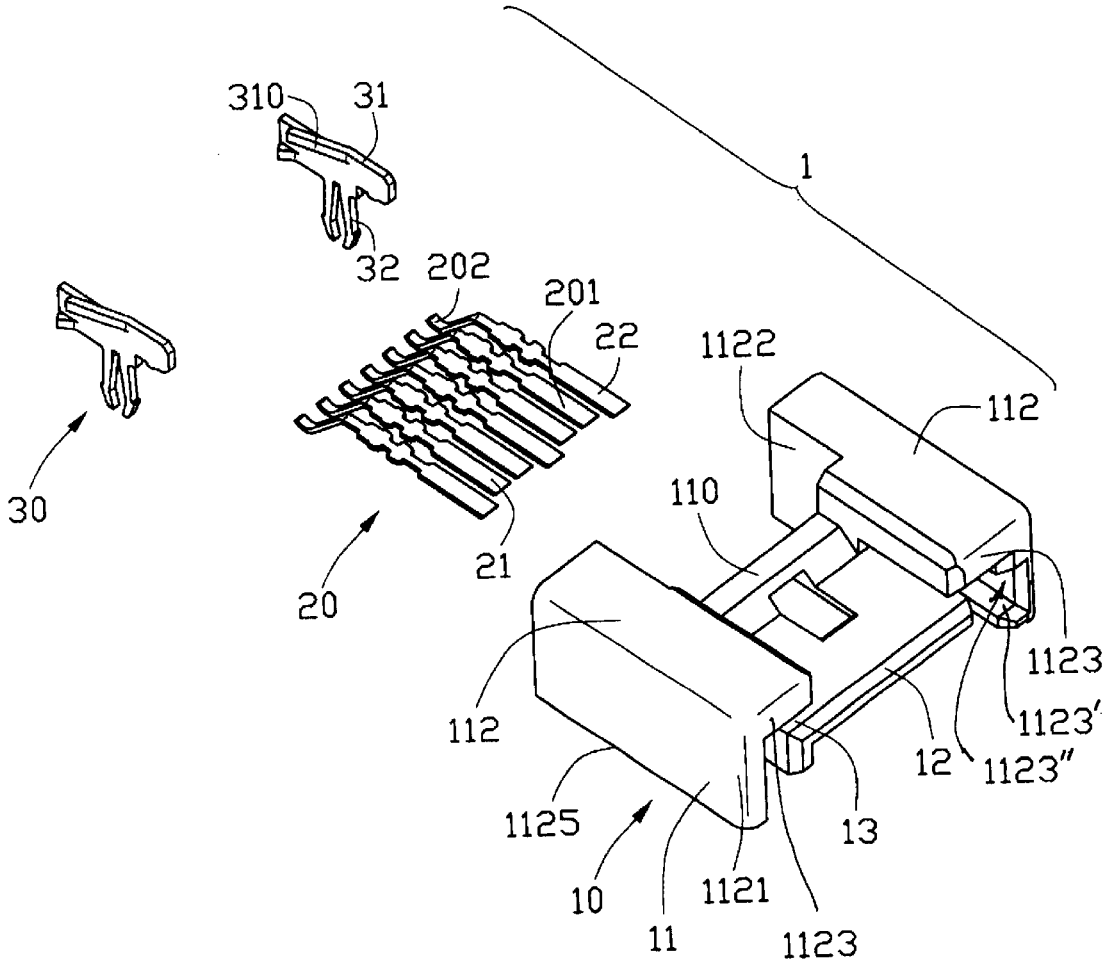
FIG. 1 is an exploded, perspective view of an electrical connector in accordance with the present invention.
Figure 2:
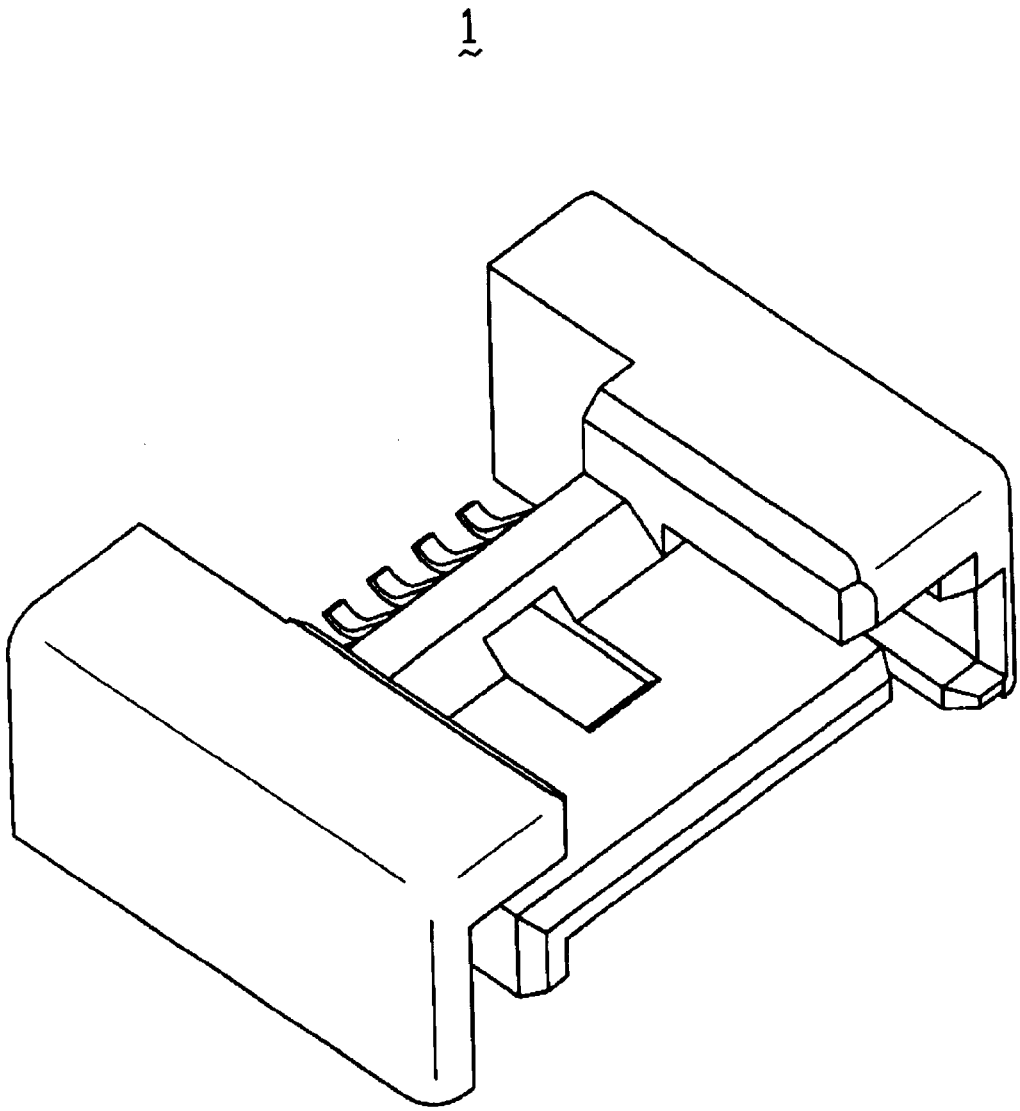
FIG. 2 is an assembled view of FIG. 1.
Figure 3:
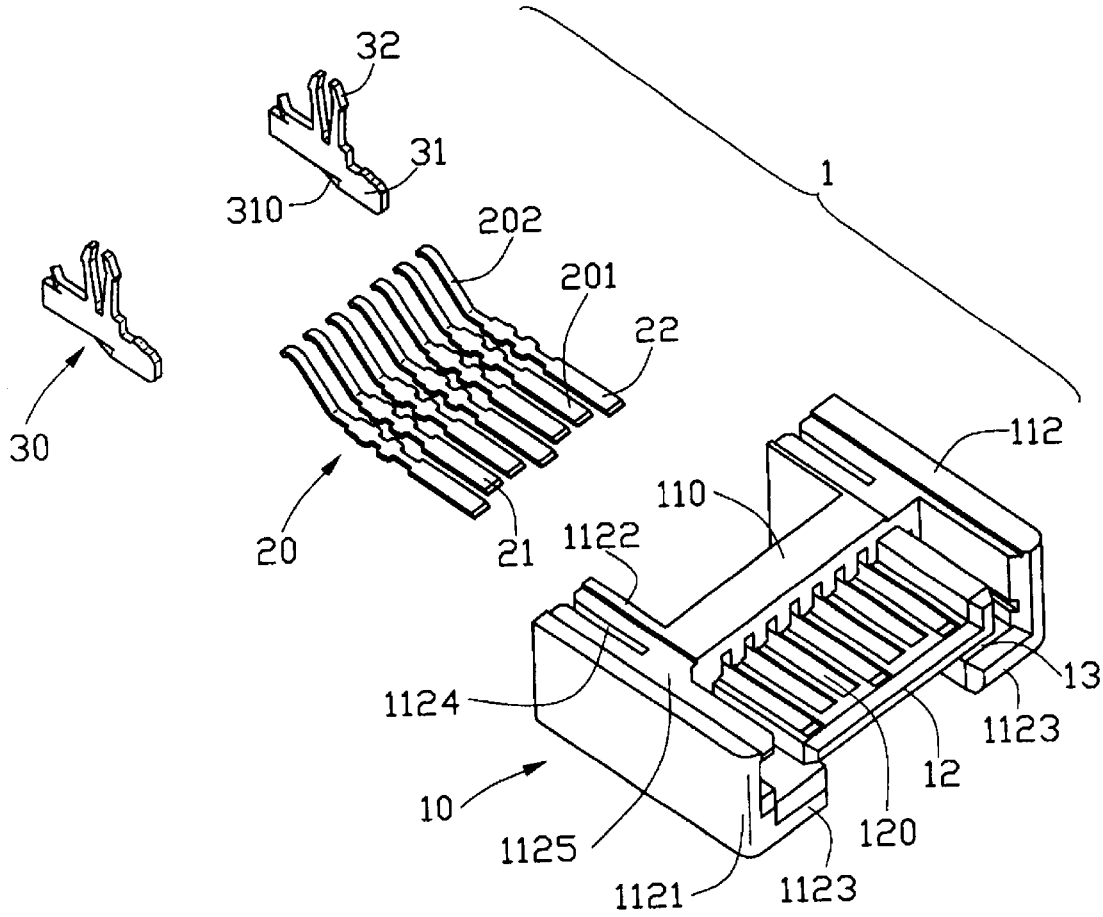
FIG. 3 is a view similar to FIG. 1 while taken from another aspect.
Figure 4:
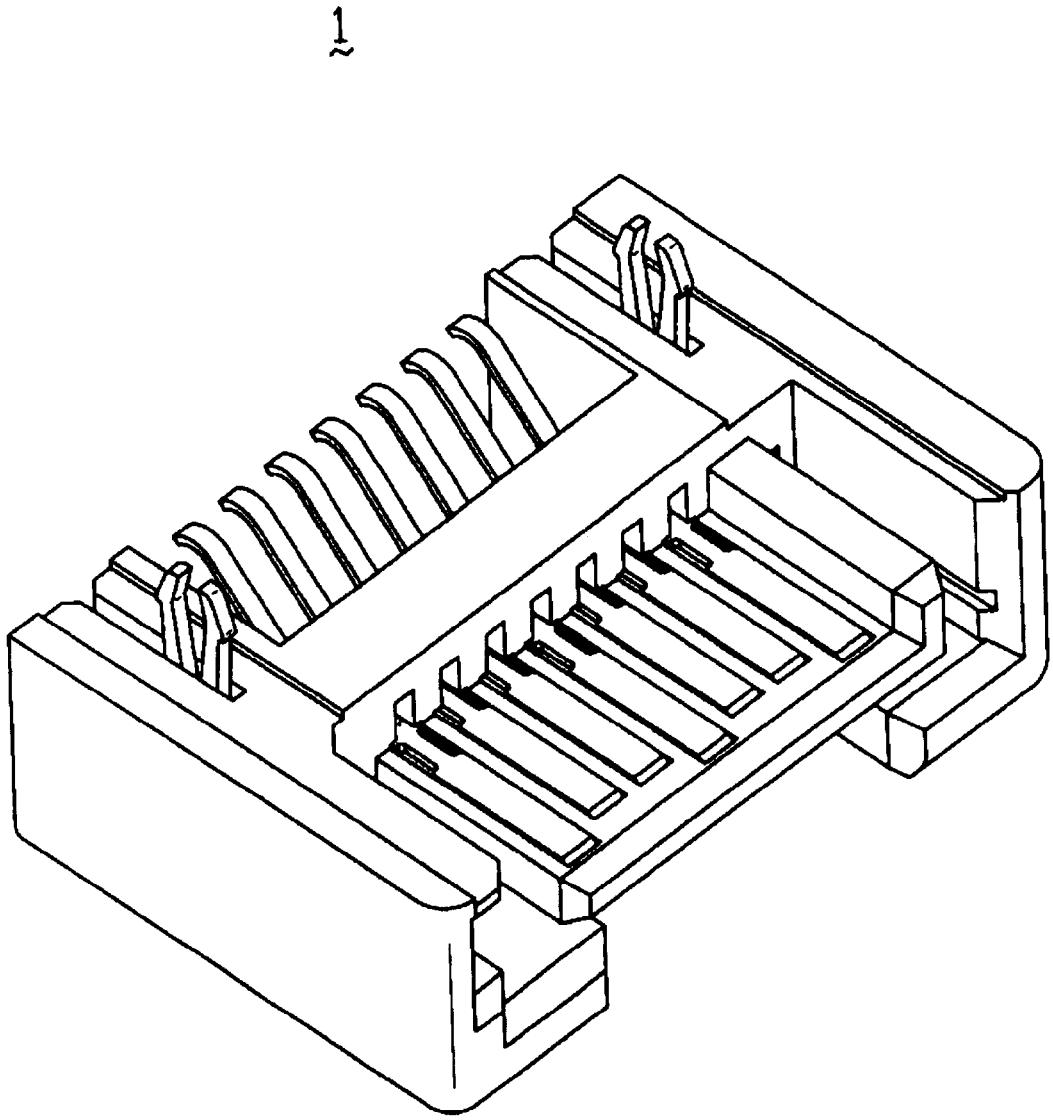
FIG. 4 is an assembled view of FIG. 3.

Reference will now be made to the drawing figures to describe the present invention in detail.

With reference to FIGS. 1–6, an electrical connector 1 adapted to be mounted on the printed circuit board 100 (FIG. 8) in accordance with the present invention and adapted for using with a Serial Advanced Technology Attachment interface and for mating with a complementary connector (not shown but possibly referred to the aforementioned U.S. Pat. No. 6,402,552), comprises an insulating housing 10, a plurality of terminals 20 disposed in the housing 10, and a pair of board locks 30 retained in the housing 10.

Figure 5:
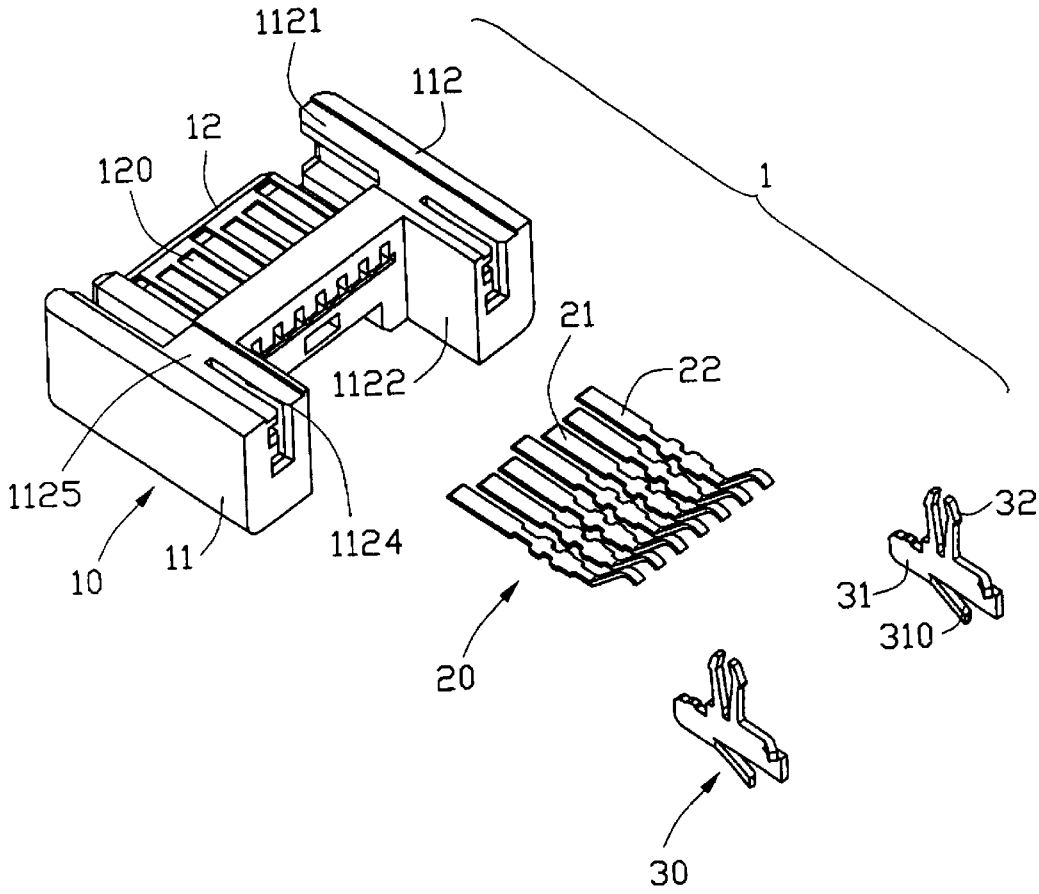
FIG. 5 is a view similar to FIG. 1 while taken from still another aspect.
Figure 6:
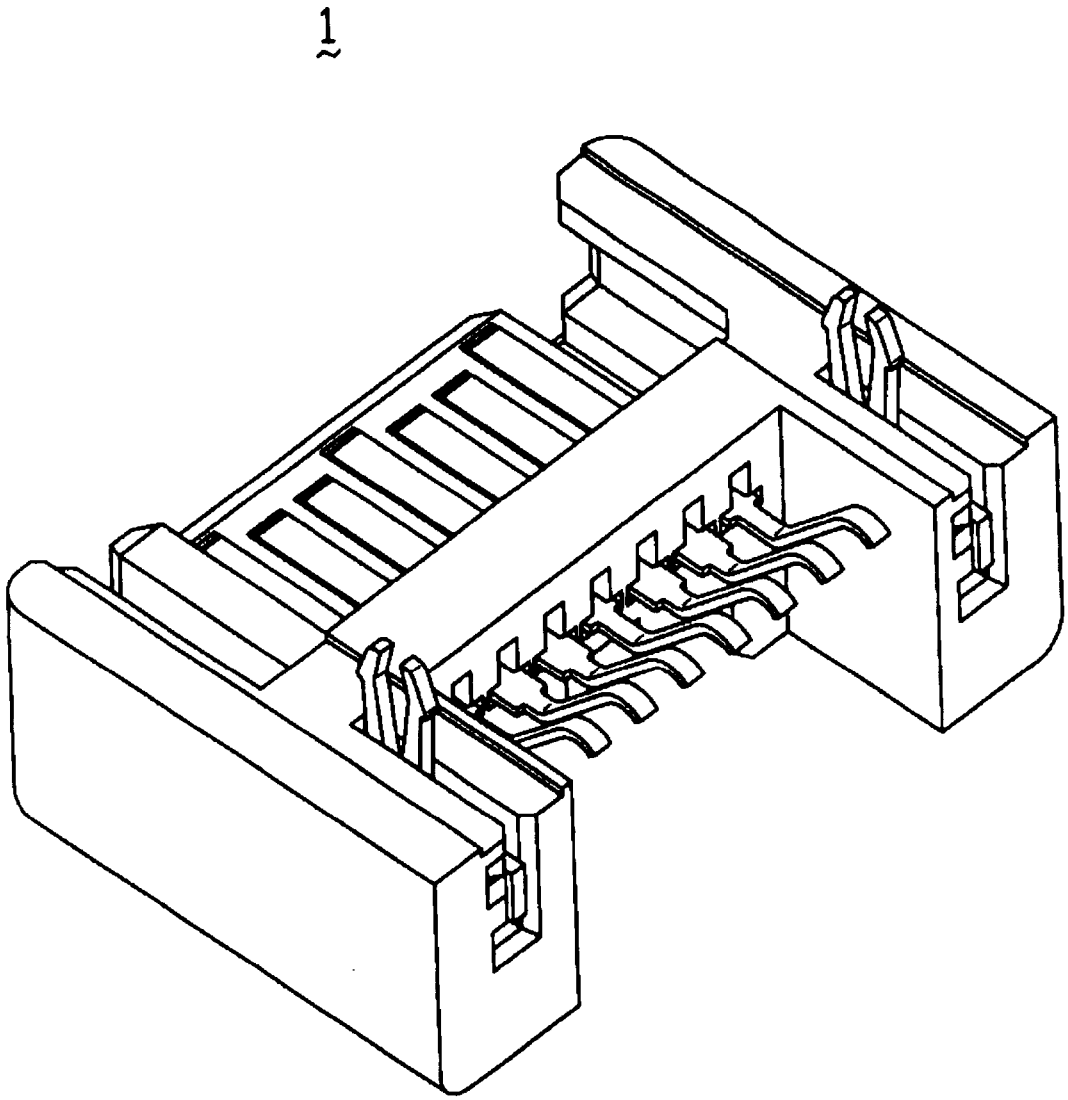
FIG. 6 is an assembled view of FIG. 5.

Particularly referring to FIGS. 1–4, the insulating housing 10 comprises a substantial H-shaped body 11 having a middle section 110 and a reversed L-shaped mating tongue 12 forwardly projecting from the middle section 110. The H-shaped body 11 has a pair of side arms 112 extending parallelly beside the mating tongue 11 with the middle section 110 connecting therebetween. Each side arm 112 includes a front portion 1121 and an oppositely extending, rear portion 1122. The front portions 1121 of the side arms 112 each have a wall or upper flange 1123 flanged thereon. One side arm 112 further includes another flange 1123' opposite to the corresponding wall 1123 and cooperatively defining a keyway 1123" for receiving a key of the complementary mating connector. The walls 1123 horizontally extend with distal edge portions right above the mating tongue 12 and toward each other. A receiving space 13 is defined between the two walls 1123 and the mating tongue 12, within which corresponding part of the mating complementary connector is received. As best shown in FIGS. 5 and 6, the rear portions 1122 of the side arms 112 each have a slot 1124 defined in a bottom face 1125 thereof. The mating tongue 12 also defines a plurality of channels 120 thereon for disposing corresponding terminals 20. A groove 1128 is further defined in an inside face of one of the side arms 112 to guide insertion of the complementary mating connector.

The terminals 20 are categorized with a plurality of signal terminals 21 and a plurality of ground terminals 22. The ground terminal 22 is longer than the signal terminal 21 such that the ground terminals 22 will engage with corresponding contacts of the complementary mating connector before the signal terminals 21 for hot plugging. The signal terminals 21 of the connector 1 of the preferred embodiment are employed to transmit differential signal pairs, which are known in the art. Each terminal 20 has a contact portion 201 extending in a corresponding channel 120 of the housing 10 and a tail portion 202 extending rearwardly between the two rear portions 1122 for soldering on a printed circuit board on which the connector 1 is mounted.

Figure 7:
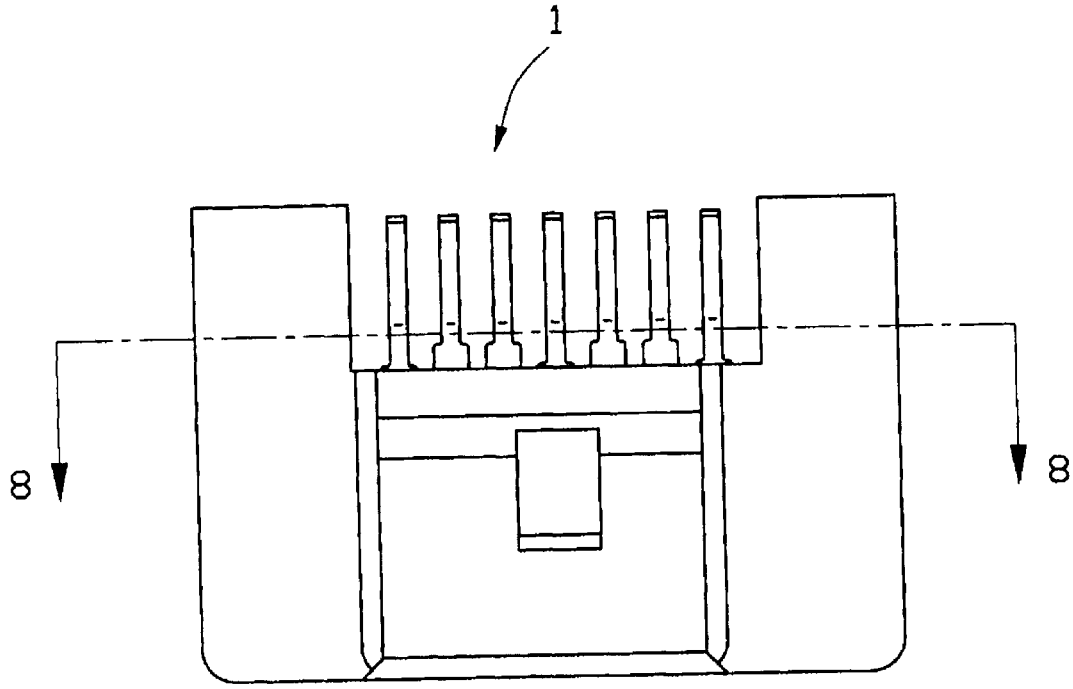
FIG. 7 is a top plan view of the electrical connector.
Figure 8:
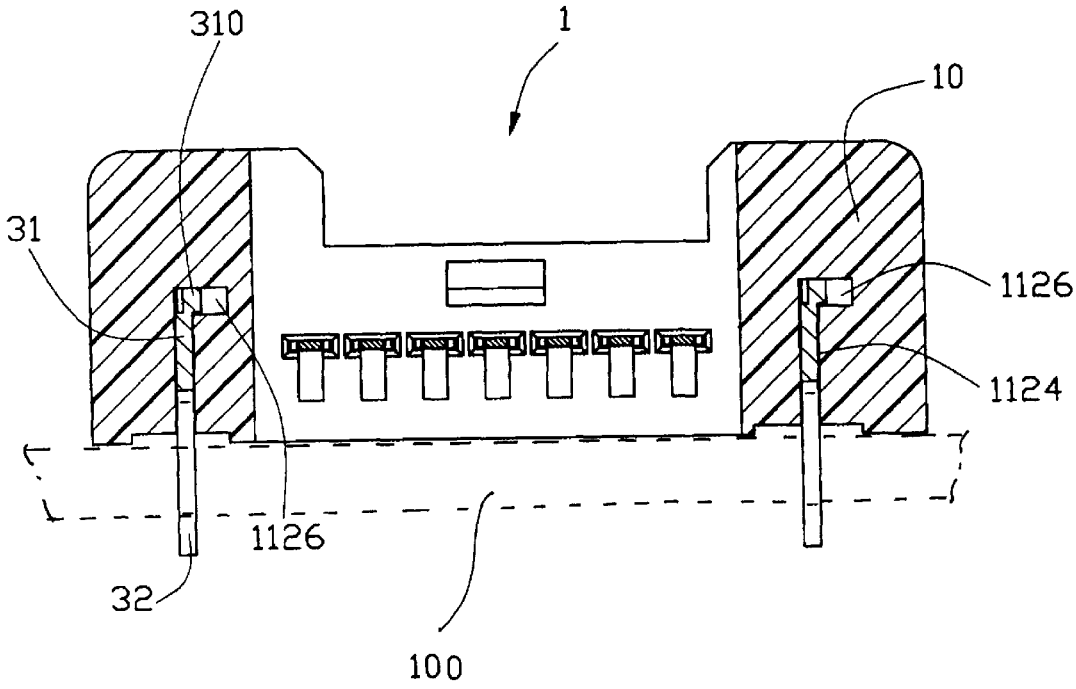
FIG. 8 is a cross-sectional view of the electrical connector taken along line 8—8 in FIG. 7.

Turning to FIGS. 7 and 8 in conjunction with FIG. 1, the pair of board locks 30 each integrally include a housing-retaining portion 31 and a board-retaining portion 32. The board-retaining portion 32 is configured in a fork shape to be engaged in a through-hole of the printed circuit board thereby securing the connector 1 on the board. The housing-retaining portion 31 is inserted and received in the slot 1124 of the housing 10. The housing-retaining portion 31 further comprises a resilient tab 310 which extend along an obliquely direction with respect to the rest of the housing-retaining portion 31. Correspondingly, the slot 1124 of the housing 10 further comprises a recess 1126 recessed in an inside wall for retaining the resilient tab 310 to thereby firmly fix the board lock 30 in the housing 10.

Compared with the related arts, the horizontally extending walls 1123 of the side arms 112, which extend above the mating tongue 11, increases the structural rigidity of the whole housing 10 so that the housing 10 can scarcely suffer from undesired breaking when the mating complementary connector are repeatedly inserted in or pulled out the connector 1 along either up-and-down or right-and-left direction. It is also noted that in this embodiment the distal ends of two opposite horizontally extending walls 1123 is spaced from each other with a relatively large distance and leaving a space therebetween for allowing an optionally equipped deflectable latch of the complementary mating connector to pass by.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

an insulating housing comprising a body having a pair of arms extending parallel to each other, a middle section connecting the arms and an inverted L-shaped mating tongue extending forwardly from the middle section, each arm comprising a wall extending above the mating tongue, the mating tongue defining a plurality of channels therein; and a plurality of terminals received in corresponding channels.

2. The electrical connector as described in claim 1, wherein the housing defines a receiving space between the walls of the arms and the mating tongue for receiving a mating complementary connector.

3. The electrical connector as described in claim 1, wherein the terminals are categorized with a plurality of signal terminals transmitting differential signal pairs and a plurality of ground terminals, the ground terminal being longer than the signal terminals.

4. The electrical connector as described in claim 1, wherein one of the arms defines a groove in an inside face thereof.

5. The electrical connector as described in claim 1, further comprising a pair of board locks.

6. The electrical connector as described in claim 5, wherein each arm comprises a rear portion defining a slot in a bottom side thereof to receive a corresponding board lock.

7. An electrical connector for mounting to a printed circuit board and mating with a complementary connector, comprising:

an insulative housing with a plurality of contacts therein, including:

a middle section defining a lengthwise direction with a mating tongue forwardly extending therefrom, said mating tongue being of an L-like configuration with a horizontal section extending along said lengthwise direction and a vertical section perpendicular to said lengthwise direction; and a first side arm located on one lengthwise end of said housing and far opposite to the vertical section of said mating tongue, said first side arm including an upper flange and a lower flange respectively horizontally extending inwardly along said lengthwise direction and commonly defining a keyway for receiving a key of the complementary connector; wherein said upper flange extends longer than said lower flange along said lengthwise direction with a distal edge portion substantially arriving above said mating tongue.

8. The connector as described in claim 7, further including a second side arm located on the other lengthwise end and close to said vertical section of the mating tongue.

9. The connector as described in claim 8, wherein said second side arm includes another upper flange extending to that of the first side arm.

10. The connector as described in claim 9, wherein the flanges of said first and second side arms are spaced from each other to leave a space therebetween for allowing portions of the complementary connector to extend therethrough.

11. The connector as described in claim 9, wherein said second side arm has no lower flange equipped therewith for not interfering with the complementary connector.

12. An electrical connector assembly for mating with a complementary connector, comprising:

an insulative housing mounted on a printed circuit board and equipped with a plurality of contacts therein, said housing including:

a middle section defining a lengthwise direction with a mating tongue forwardly extending therefrom, said mating tongue being of an L-like configuration with a horizontal section extending along said lengthwise direction and a vertical section perpendicular to said lengthwise direction;

a first side arm located on one lengthwise end of said housing and far opposite to the vertical section of said mating tongue, said first side arm including a flange extending inwardly along said lengthwise direction; and a second side arm located on the other lengthwise end of the housing and close to the vertical section of the mating tongue, said second side arm including another flange extending toward that of the first side arm; wherein distal edge portions of said two flanges of the first and second side arms are spaced from each other with a distance for allowing portions of the complementary connector to extend therethrough.

13. The assembly as described in claim 12, wherein the flange of the second side arm directly faces the printed circuit board while the flange of the first side arm is blocked by another flange of the first side arm.

14. The assembly as described in claim 12, wherein the distal edge portion of at least one of said flanges of said first and second side arms reaches a position overlapped with the mating tongue in a direction perpendicular to said lengthwise direction.

15. The assembly as described in claim 12, wherein said flanges of said first and second side arms are located by one side of the horizontal section while the vertical section is located on the other side of the horizontal section.

16. The assembly as described in claim 12, wherein said flanges are parallel to said printed circuit board.

* * * * *